US008336741B2

(12) United States Patent
Graviss et al.

(10) Patent No.: US 8,336,741 B2
(45) Date of Patent: Dec. 25, 2012

(54) FRONT-ACCESSIBLE ICE DISPENSER ICE AGITATION MOTOR

(75) Inventors: Kenton J. Graviss, Louisville, KY (US); Merritt Todd Teague, New Washington, IN (US); Dennis Lee Heinz, Floyds Knobs, IN (US)

(73) Assignee: Manitowoc Foodservice Companies, LLC, Manitowoc, WI (US)

( * ) Notice: Subject to any disclaimer, the term of this patent is extended or adjusted under 35 U.S.C. 154(b) by 959 days.

(21) Appl. No.: 12/145,245

(22) Filed: Jun. 24, 2008

(65) Prior Publication Data

US 2009/0314796 A1 Dec. 24, 2009

(51) Int. Cl.
*B67D 7/80* (2010.01)

(52) U.S. Cl. ..... 222/242; 222/146.6; 222/333; 222/504; 62/320; 62/344; 62/390

(58) Field of Classification Search ..... 222/146.6, 222/226, 236, 239–242, 333, 504; 62/320, 62/344, 381, 389, 390, 396, 400
See application file for complete search history.

(56) References Cited

U.S. PATENT DOCUMENTS 3,059,450 A * 10/1962 Mueller et al. ..... 62/344
5,056,688 A * 10/1991 Goetz et al. ..... 222/146.6
5,494,194 A * 2/1996 Topper et al. ..... 222/146.6
5,829,646 A 11/1998 Schroeder et al.
6,039,220 A 3/2000 Jablonski et al.
6,145,803 A 11/2000 Emody et al.
7,186,087 B2 3/2007 Romanyszyn
7,748,571 B2 * 7/2010 Goff et al. ..... 222/146.6

OTHER PUBLICATIONS

Canadian Office Action dated Oct. 24, 2011 for corresponding Canadian Patent Application No. 2,639,164.
Grivory GV, "The Economical Alternative to Aluminum, Magnesium and Zinc Alloy Die-Cast Components," Feb. 1, 2000, 6 pages.
"Manitowoc S Model Dispenser Install, Use, and Care Manual," Part No. 5030864, Jul. 2007, 40 pages.
Office Action dated Oct. 18, 2011 for corresponding Mexican Patent Application No. MX/a/2008/011638 with a general translation of the Office Action.

* cited by examiner

*Primary Examiner* — J. Casimer Jacyna
(74) *Attorney, Agent, or Firm* — Ohlandt, Greeley, Ruggiero & Perle, L.L.P.

(57) ABSTRACT

An ice dispenser includes an ice storage bin with a drive shaft aperture and an ice dispensing aperture; an ice dispensing chute connected to the storage bin in proximity to the ice dispensing aperture; a paddlewheel inside the storage bin; and a drive mechanism, including a drive shaft passing through tile drive shaft aperture, for rotation of the paddlewheel. The drive shaft is connected to tile paddlewheel in such a fashion that the paddlewheel is prevented from disengaging from the drive shaft during normal operation of the ice dispensing apparatus, but the drive shaft can be disengaged from the paddlewheel in order to be able to remove the drive mechanism from the ice dispenser without accessing the ice storage bin.

12 Claims, 6 Drawing Sheets

FRONT-ACCESSIBLE ICE DISPENSER ICE AGITATION MOTOR

FIELD OF THE INVENTION

The present invention relates to ice dispensers, and more particularly to an improved method of connecting a drive mechanism to a paddlewheel of an ice dispenser so that the drive shaft can be disengaged from the paddlewheel in order to be able to remove the drive mechanism from the ice dispenser without accessing the ice storage bin. The invention also relates to an improved paddlewheel, and ice and beverage dispensers that use the improved drive mechanism.

BACKGROUND OF THE INVENTION

In the post-mix beverage dispensing industry, most beverages are served with a form of ice. Ice can be scooped out of a bin and placed into a cup before the beverage is added. However, ice dispensers are frequently used to add ice to the cup when a large number of beverage servings are routinely needed. Most ice dispensers on the market use an interior ice bin that may be manually or automatically filled. Ice in the ice bin is then picked up by a rotating paddlewheel having ice engagement members, passed over an opening, and dispensed through a chute into a cup. The bin will generally include an agitator for breaking up the ice. An electric motor is used to drive a gear assembly and drive shaft that extends into the bin, onto which shaft the paddlewheel and agitator are attached. Beverage dispenser manufacturers have integrated ice dispensers into beverage dispensers.

Heretofore, removal of the drive gear and motor for repair or replacement has been difficult. Currently, service personnel must access the ice bin to remove the ice agitation motor. This removal is difficult because the drive shaft is attached to the paddlewheel and agitator, often using a pin, in a location that requires access to the ice storage bin. Any ice in the storage bin must be removed in order to disconnect the pin, allowing the drive shaft to be disconnected from the paddlewheel. Removal of the motor becomes even more time consuming if an ice making machine, automatically supplying ice, is mounted over the ice storage bin. The icemaker must then be moved or removed to access the storage bin to disconnect the pin. The result can be an increase in the cost of a service call to fix or replace an ice dispenser agitation motor. Accordingly, it would be desirable to connect a drive mechanism to a paddlewheel of an ice dispenser so that the drive shaft can be disengaged from the paddlewheel in order to be able to remove the drive mechanism from the ice dispenser without accessing the ice storage bin.

SUMMARY OF THE INVENTION

An ice dispenser has been invented in which the ice agitation motor can be removed without needing access to the ice storage bin. In a first aspect, the invention is an ice dispenser comprising an ice storage bin with a drive shaft aperture and an ice dispensing aperture; an ice dispensing chute connected to the storage bin in proximity to the ice dispensing aperture; a paddlewheel inside the storage bin; and a drive mechanism, including a drive shaft passing through the drive shaft aperture, for rotation of the paddlewheel. The drive shaft is connected to the paddlewheel in such a fashion that the paddlewheel is prevented from disengaging from the drive shaft during normal operation of the ice dispensing apparatus, but the drive shaft can be disengaged from the paddlewheel in order to be able to remove the drive mechanism from the ice dispenser without accessing the ice storage bin.

In another aspect, the invention is a paddlewheel for use in an ice dispenser, the paddlewheel comprising molded plastic, and including a rigid coupler molded into the paddlewheel having first and second axial opening at opposite ends for receiving a drive shaft and an agitator shaft, the coupler having a larger dimension in its central section than at its ends.

In still another aspect, the invention is a combined ice and beverage dispenser comprising at least one beverage dispensing nozzle; an ice storage bin with a drive shaft aperture and an ice dispensing aperture; an ice dispensing chute connected to the storage bin in proximity to the ice dispensing aperture; at least one paddlewheel located in the ice storage bin, the paddlewheel being made of molded plastic and comprising a rigid coupler molded into the paddlewheel, extending axially through the paddlewheel, the coupler having a first opening; and a drive motor and gear assembly having a drive shaft extending through the drive shaft aperture and into the coupler. The drive shaft fits into the first opening of the coupler. The drive shaft and opening have surfaces configured to transmit torque from the drive shaft, through the coupler, to rotate the paddlewheel. The drive shaft slides into the coupler to engage the paddlewheel during normal operation, so that the drive motor and gear assembly can be detached from the paddlewheel without accessing the ice storage bin.

With the present invention, a service person can remove the ice agitation motor from the front of the dispenser without ever having to access the inside of the storage bin. An automatic ice maker placed over the bin to automatically supply ice therefore does not need to be moved when an ice agitation motor requires service. These and other advantages of the invention, as well as the invention itself, will be better understood in view of the attached drawings.

DESCRIPTION OF THE DRAWINGS AND THE PRESENTLY PREFERRED EMBODIMENTS

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

A phrase used in the specification and claims has a meaning defined as follows. The phrase "the drive shaft can be disengaged from the paddlewheel in order to be able to remove the drive mechanism from the ice dispenser without accessing the ice storage bin" means that ice can be left in the storage bin adjacent to the paddlewheel and the driving mechanism can be uncoupled from the paddlewheel without anyone having to reach into the ice storage bin, or any tools needing to be used inside the ice storage bin.

Figure 1:
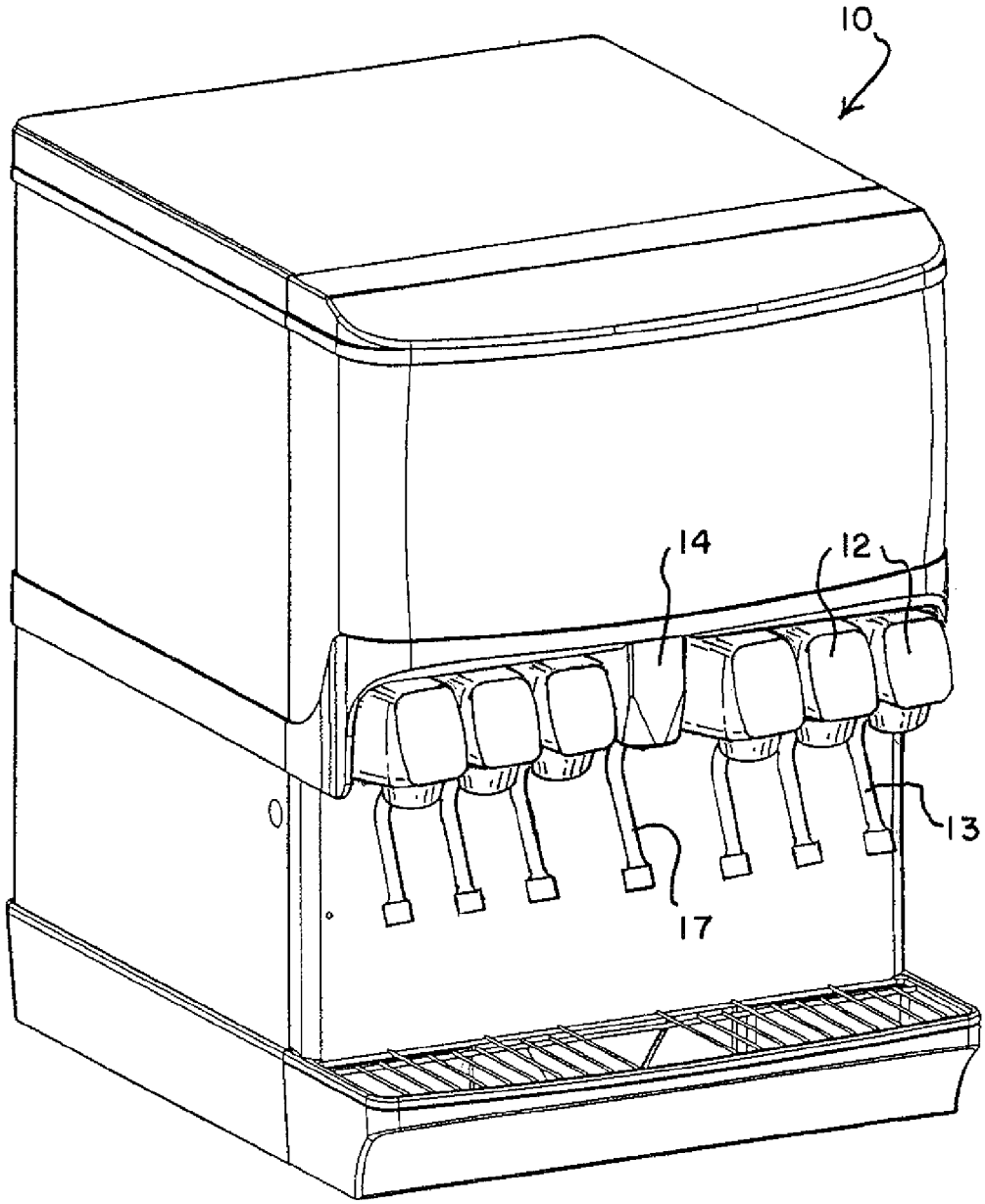
FIG. 1 is a front perspective view of an ice and beverage dispenser utilizing the present invention.

FIG. 1 shows a combined ice and beverage dispenser 10 in which the present invention is particularly useful. The dispenser 10 includes conventional beverage dispensing valves 12 operated by lever arms 13 in a conventional manner. The dispenser also includes an ice dispensing chute 14, operated by lever 17 in a conventional manner. In these features, the combined ice and beverage dispenser 10 is like prior art ice and beverage dispenser 110 shown in FIG. 2. In the prior art device, motor 112 is connected to a reducing gear 114, the drive shaft 116 of which extends into the ice bin 118. Paddlewheel 120 is molded to include a stainless steel insert 122 that engages the shaft 116, causing the paddlewheel to turn when the agitator motor 112 is operated. The end of drive shaft 116 is connected to the agitator shaft 130 through a drive coupling 150. The drive coupling 150, agitator shaft 130 and drive shaft 116 each have holes through them. A first pin 134 passes through holes in the drive coupling 150 and the end of the drive shaft 116. A second pin 136 passes through another set of holes in the drive coupling and the proximal end of agitator shaft 130. In this manner torque from the motor 112 and gear 114 is transmitted through the drive coupling 150 to turn agitator shaft 130. The distal end of agitator shaft 130 is held in place on the back wall 180 of the ice bin 118 by a bracket 170. Bracket 170 includes a bore 172 into which the distal end of agitator shaft 130 can slide.

Figure 2:
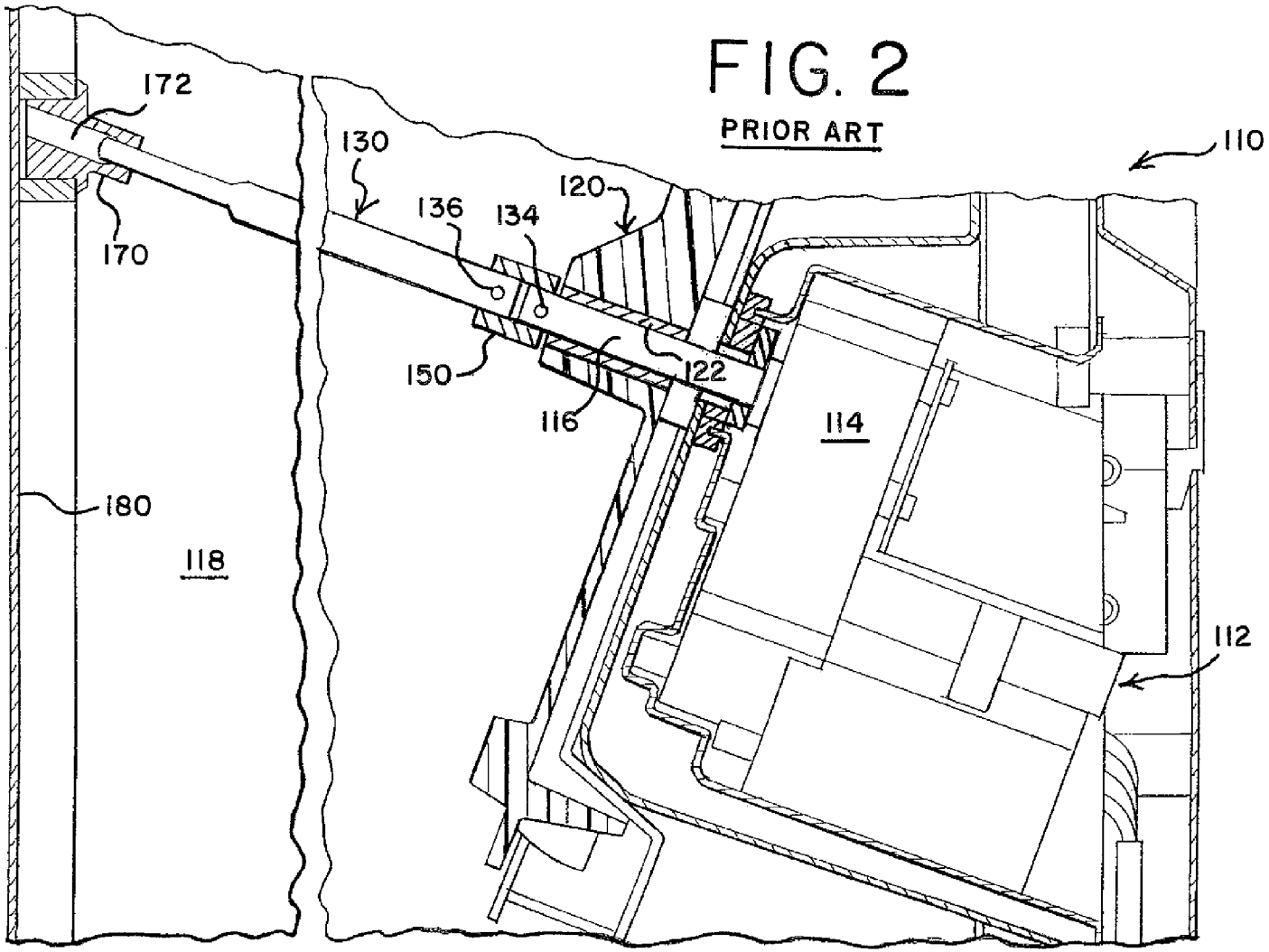
FIG. 2 PRIOR ART
FIG. 2 is a cross-sectional view of a drive mechanism, paddlewheel and ice bin agitator constructed according to the prior art.

When the agitator needs to be disconnected from the drive shaft 116, pin 136 is pulled and the agitator is shifted to the left (in FIG. 2). The bore 172 accepts the distal end of the agitator shaft to the extent necessary for the proximal end to be pulled from drive coupling 150. If the drive motor and gear are to be removed, pin 134 is pulled, allowing drive shaft 116 to slide through the insert 122. As described above, since it is necessary to pull pin 134 to disengage the drive shaft 116 from the agitator shaft 130 if the agitator motor 112 and associated gear 114 are being replaced, it is necessary to remove the ice in ice bin 118, as well as remove any ice making machine that might be placed on top of the ice bin 118, in order to get access to pull the pins 134 and 136.

Figure 3:
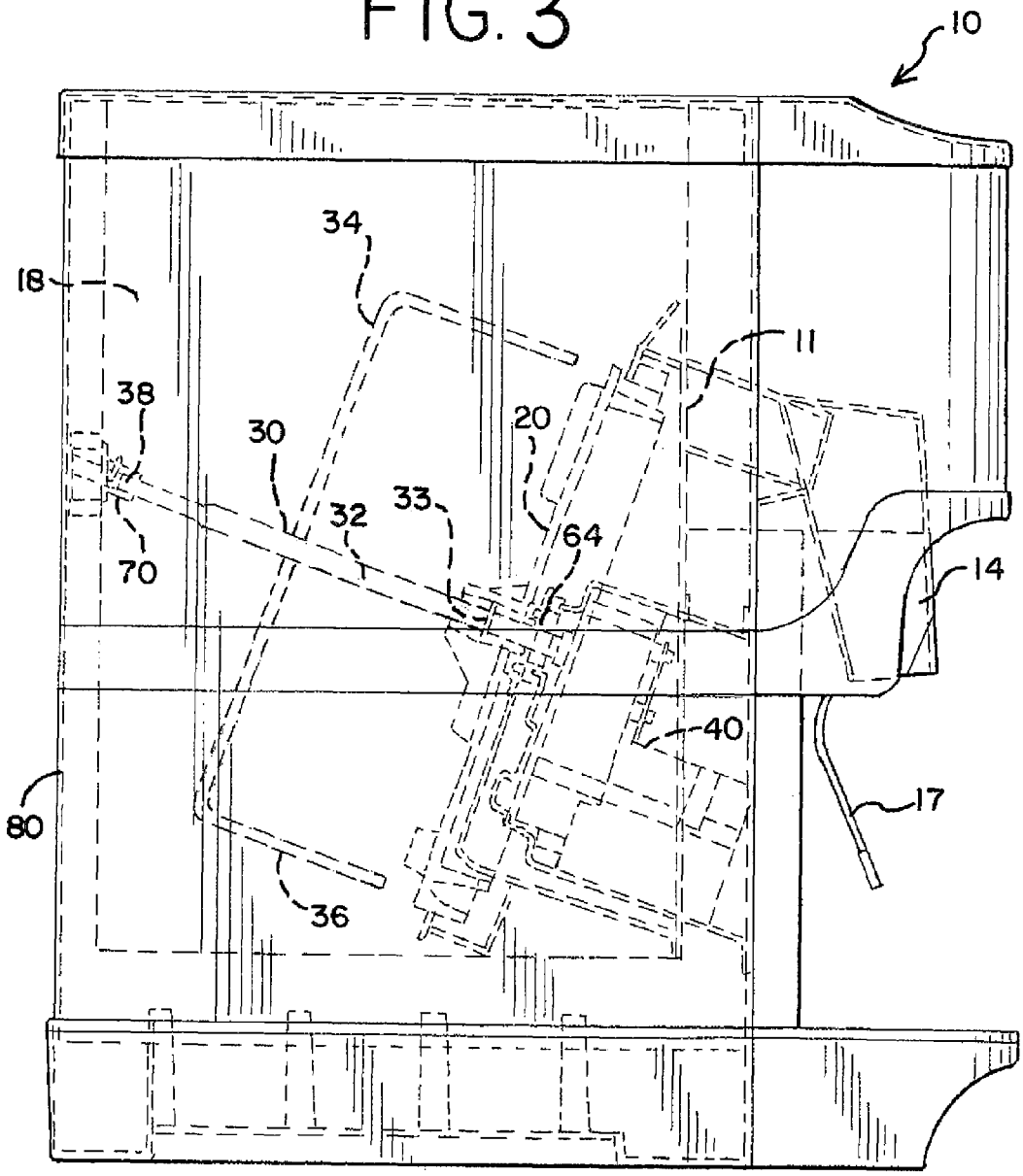
FIG. 3 is a side elevation view of the ice and beverage dispenser of FIG. 1 showing the drive mechanism, paddlewheel and ice bin agitator in phantom lines.
Figure 4:
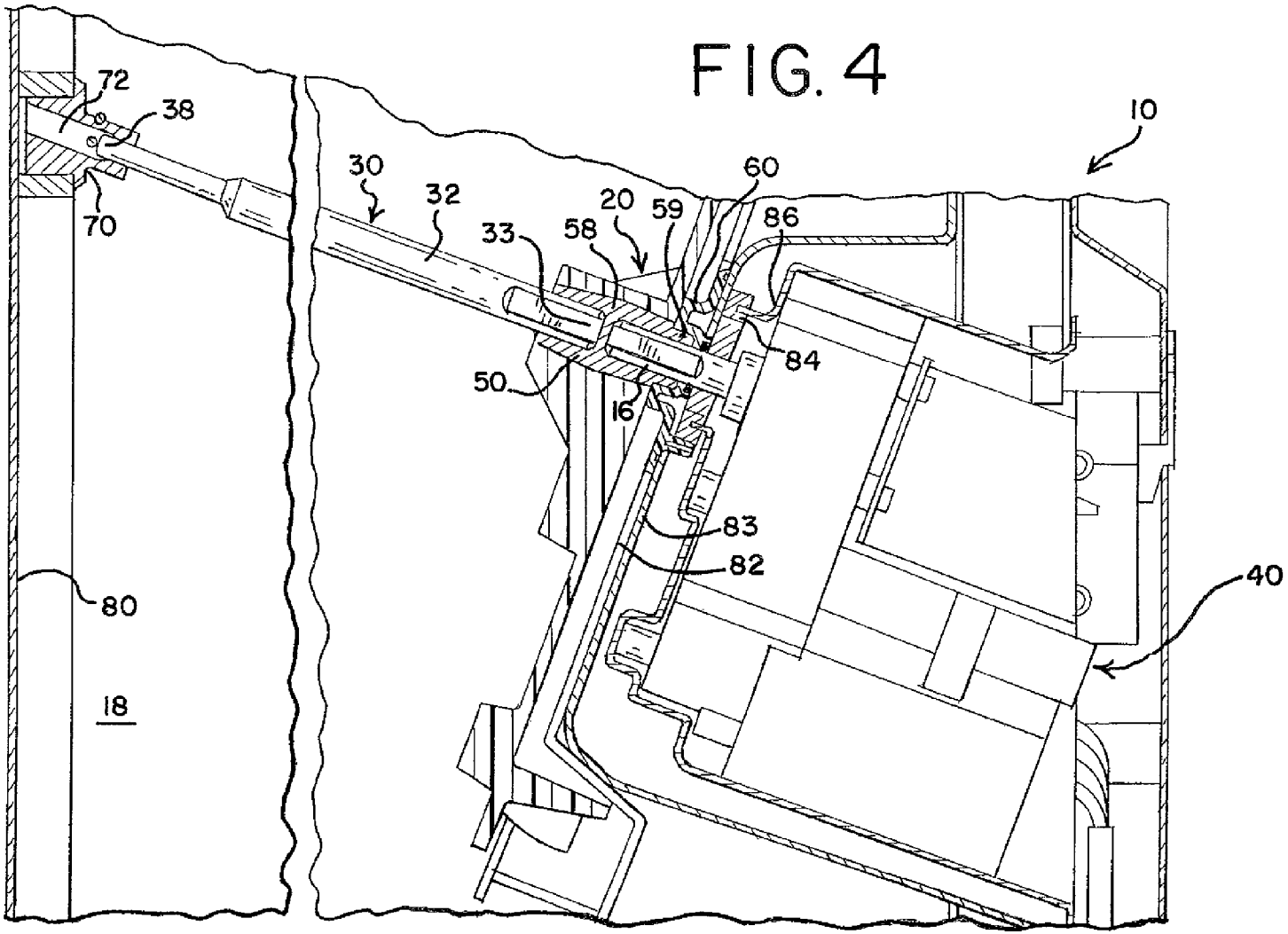
FIG. 4 is a cross-sectional view of the drive mechanism, paddlewheel and ice bin agitator of the ice and beverage dispenser of FIGS. 1 and 3 shown in a normal operational position.

FIGS. 3-4 show a preferred embodiment of the connection arrangement between the agitator shaft and the drive shaft in the dispenser 10 of the present invention. The dispenser 10 includes an ice storage bin 18 with a drive shaft aperture 64 and an ice dispensing aperture 11. The ice dispensing chute 14 is connected to the storage bin 18 in proximity to the ice dispensing aperture. A paddlewheel 20 and agitator 30 are mounted inside the storage bin 18. The agitator 30 comprises a shaft 32 with a first, proximal end 33 and a second, distal end 38, and extends through the ice bin 18 and is supported by the rear wall 80 of the ice bin opposite the paddlewheel. The agitator 30 may have side extensions, such as the extensions 34 and arms 36 shown in FIG. 3.

Figure 5:
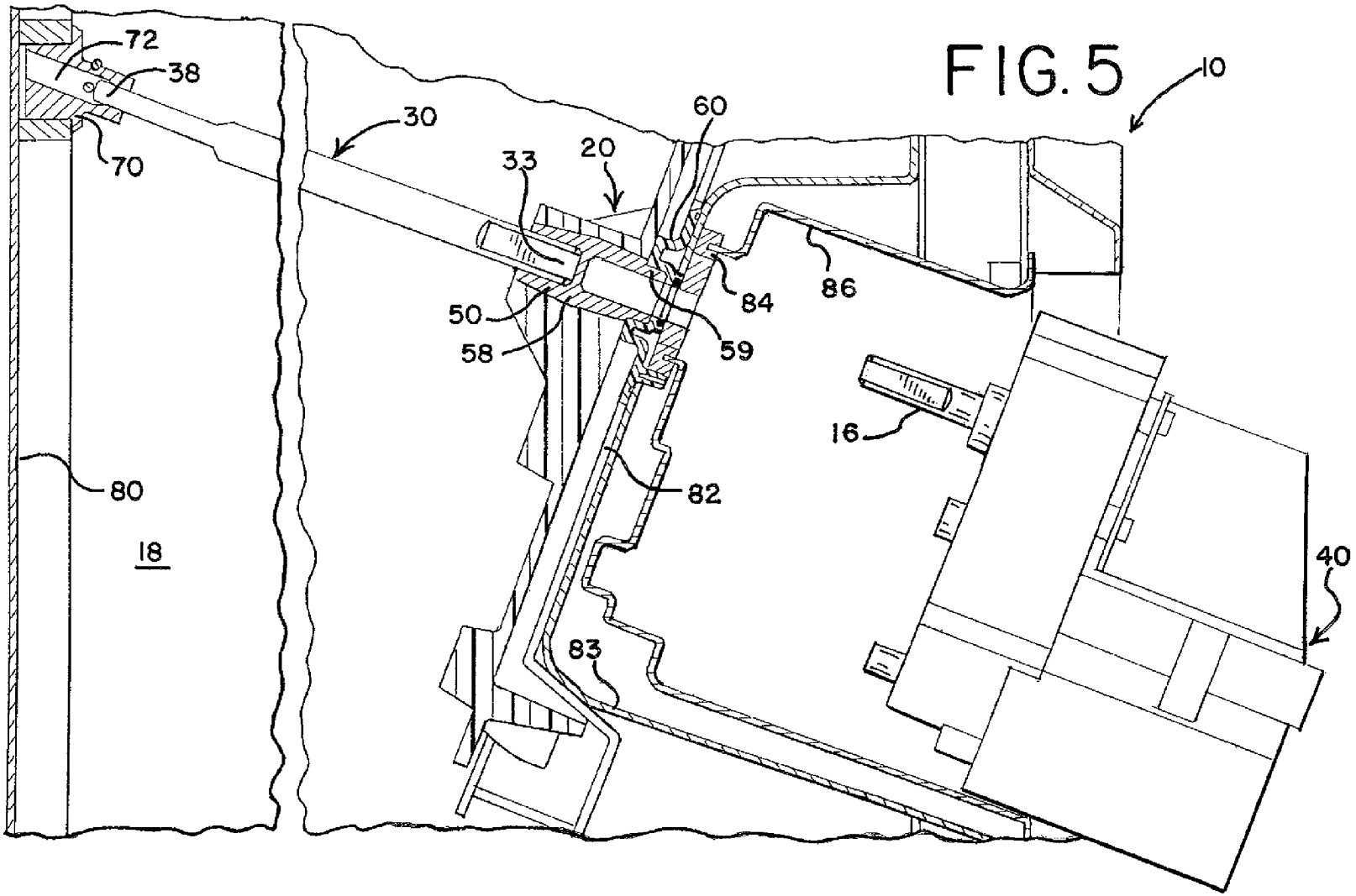
FIG. 5 is a cross-sectional view of the drive mechanism, paddlewheel and ice bin agitator of the ice and beverage dispenser of FIGS. 1 and 3 shown in a position where the drive mechanism has been disengaged.

A drive mechanism, such as motor and gear assembly 40, includes a drive shaft 16 passing through the drive shaft aperture 64 and extends into the ice storage bin 18. The drive shaft 16 is driven by the drive mechanism and coupled to the paddlewheel 20 and to the agitator 30 so as to agitate ice in the bin when the drive mechanism rotates the paddlewheel 20. The drive shaft 16 is connected to the paddlewheel 20 in such a fashion that the paddlewheel 20 is prevented from disengaging from the drive shaft 16 during normal operation of the ice dispensing apparatus, but the drive shaft can be disengaged from the paddlewheel in order to be able to remove the drive mechanism 40 from the ice dispenser 10 without accessing the ice storage bin 18, as shown in FIG. 5.

Figures 6, 7, 8, 9:
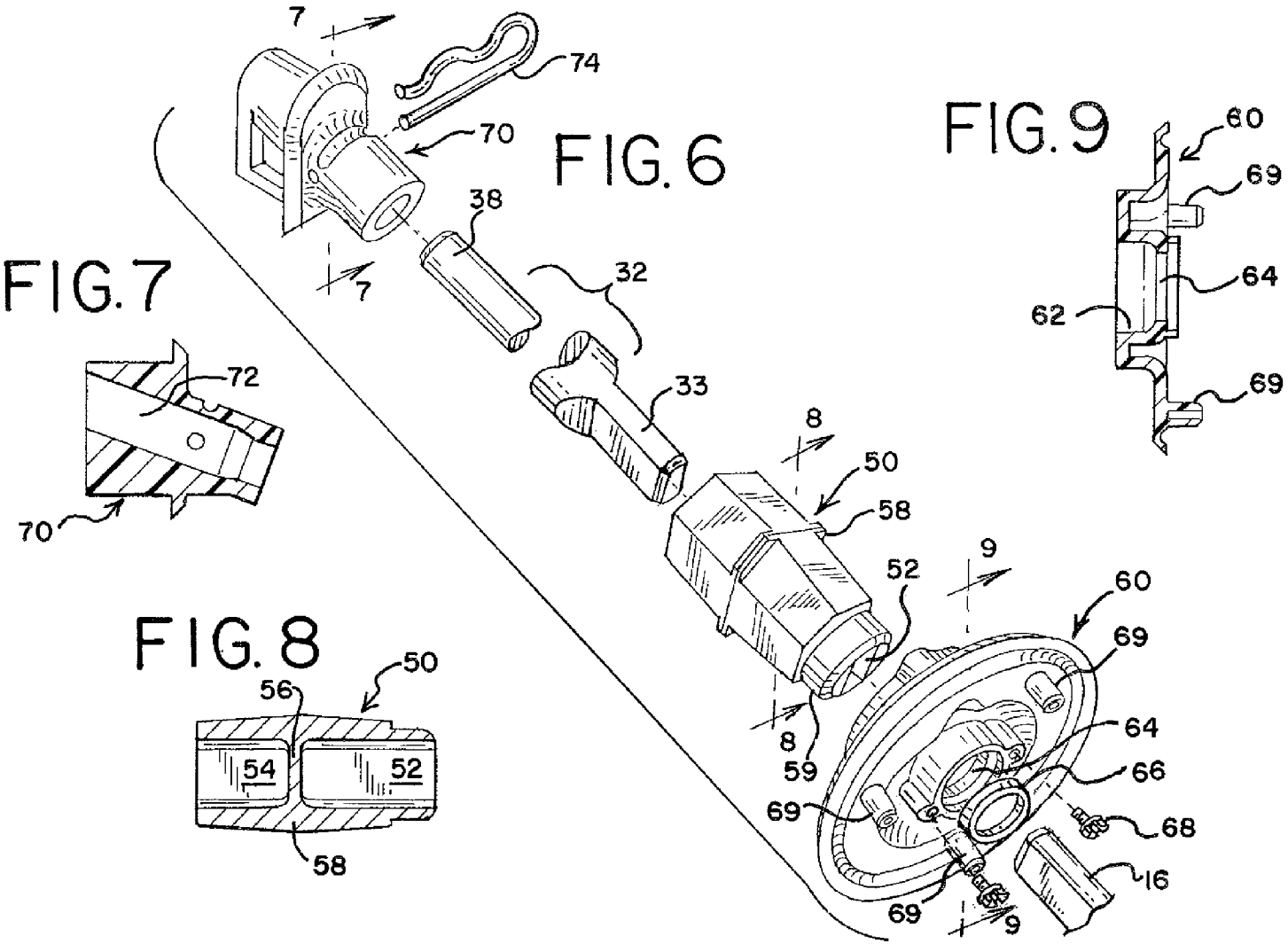
FIG. 6 is an exploded view of the drive shaft, paddlewheel bushing, coupler, agitator shaft and rear wall bushing of the ice and beverage dispenser of FIGS. 1 and 3-5.
FIG. 7 is a cross-sectional view of the rear wall bushing of FIG. 6 taken along line 7-7.
FIG. 8 is a cross sectional view of the coupler of FIG. 6 taken along line 8-8.
FIG. 9 is a cross-sectional view of the paddlewheel bushing of FIG. 6 taken along line 9-9.

The connection of the drive shaft 16 to the paddlewheel 20 comprises a coupler 50, extending axially through the paddlewheel. The coupler 50 is made of a rigid material, having a Young's modulus of at least 2,000,000 psi, and has two axial openings 52, 54, separated by a wall 56 in its center region (FIG. 8). The drive shaft 16 extends through the drive shaft aperture and into the coupler 50, the drive shaft fitting into the first opening 52 of the coupler. The shaft 32 driving the ice bin agitator 30 extends into the second axial opening 54. The drive shaft 16 and opening 52 have surfaces configured to transmit torque from the drive shaft, through the coupler, to rotate the paddlewheel. The axial openings have at least one flattened side, best seen in FIG. 6, allowing torque to be transmitted by the drive shaft, fitting into the first opening, to the agitator shaft, fitting into the second opening. The drive shaft is slideably engaged in the coupler 50 during normal operation, so that the drive motor and gear assembly 40 can be detached from the paddlewheel 20 without accessing the ice storage bin 18.

The outside of the coupler 50 has a generally hexagonal cross section (FIG. 6), the hexagonal shape helping to transmit torque from the drive shaft 16 to the paddlewheel 20. The paddlewheel is made of molded plastic that is typically not as rigid as the coupler, and the coupler is molded into the paddlewheel. The coupler has a larger dimension in its central section, i.e., it is wider in the central region 58, than at its ends, thus helping to secure the coupler in the paddlewheel 20.

A bushing 70 (FIG. 7) is used to support the agitator shaft 32 on the rear wall 80. The bushing includes a cavity 72 and a removable stop in the form of a locking pin 74, the stop being in place during normal operation to prevent the agitator shaft from moving axially in the cavity, thus preventing the paddlewheel from disengaging from the drive shaft during normal operation. The cavity 72 is deep enough that when the pin 74 is removed, the second end 38 of the agitator shaft can slide deeper into the cavity 72, allowing the first end of the agitator shaft 33 to be disconnected from the drive mechanism.

The paddlewheel 20 and ice storage bin 18 have an interconnection at the drive shaft aperture that keeps the paddlewheel aligned with the drive shaft aperture even when the drive shaft 16 is not present. The interconnection provides an extension to the wall of the ice storage bin so that the paddlewheel fits within a recess. In a preferred embodiment, the extension is provided by a collar 59 on the coupler, and a paddlewheel bushing 60 (FIG. 9) provides the recess 62 in the wall 82 of the ice storage bin. The bushing 60 also contains the drive shaft aperture 64 into the ice bin. An oil seal 66 is held in the aperture 64 by screws in the paddlewheel bushing 68. Three hollow bosses 69 on the back of the bushing 60 are used to connect the bushing 60 to the chute motor box 83. Push nuts are used to secure the bushing to the chute motor box. A foam gasket 84 seals between the motor insulation 86 and the front wall 82 of the ice bin contain paddlewheel bushing 60 and chute motor box 83.

The motor drive shaft 16 has chamfers in the axial direction at the double 'D' area to compensate for any misalignment, up to 15 degrees, to ease installation. Also the end of the motor shaft has a chamfer around the end to likewise ease insertion of the motor shaft into the coupler 50.

The coupler 50, having a double 'D' configuration, provides driving means while allowing the removal of the motor without removing any pins, screw or any other fastening device. To remove the motor, two pins (not shown) accessible from the front of the dispenser, are pulled and the wiring harness is disconnected, and the motor is pulled out without any further steps.

One benefit of the preferred embodiment is that the coupler 50, when made of molded metal or rigid plastic, is less expensive than a machined coupling of the prior art. The coupler may be made of molded metal or a rigid plastic having a Young's modulus of at least 2,000,000 psi, such as a glass filled nylon, particularly Grivory GV-6H, available from EMS-CHEMIE (North America) Inc., 2060 Corporate Way, Sumter, S.C. 29151, which has a Young's modulus of 20,000 MPa, about 2,900,000 psi. By contrast, the paddlewheel 20 will typically be made of a talc filled polypropylene having a Young's modulus of about 300,000 psi.

It should be understood that various changes and modifications to the presently preferred embodiments described herein will be apparent to those skilled in the art. For example, the paddlewheel bushing could be a molded part of a plastic ice bin rather than a separate piece. Further, parts of the ice dispenser need not always be directly connected together as shown in the drawings. Such changes and modifications can be made without departing from the spirit and scope of the present invention and without diminishing its intended advantages. It is therefore intended that such changes and modifications be covered by the appended claims.

What is claimed is:

1. An ice dispenser comprising:

a) an ice storage bin with a drive shaft aperture and an ice dispensing aperture;

b) an ice dispensing chute connected to the storage bin in proximity to the ice dispensing aperture;

c) a paddlewheel inside the storage bin; and d) a drive mechanism, including a solid drive shaft passing through the drive shaft aperture, for rotation of the paddlewheel, said paddlewheel not directly in contact with said drive shaft;

e) the drive shaft being slidably connected to the paddlewheel without any fastening device in such a fashion that the paddlewheel is prevented from disengaging from the drive shaft during normal operation of the ice dispensing apparatus, but the drive shaft can be disengaged from the paddlewheel in order to be able to remove the drive mechanism from the ice dispenser without accessing the ice storage bin, wherein the paddlewheel and ice storage bin have an interconnection at the drive shaft aperture that keeps the paddlewheel aligned with the drive shaft aperture even when the drive shaft is not present, wherein the paddlewheel and ice storage bin have a further interconnection provided by an extension on the paddlewheel that fits within a recess of a wall of the ice storage bin and wherein the paddlewheel comprises a coupler that attaches to the drive shaft, the coupler being molded into the paddlewheel, and the extension is provided by a collar on the coupler.

2. The ice dispenser of claim 1 wherein the wall of the ice storage bin containing said recess is provided by a paddlewheel bushing.

3. The ice dispenser of claim 1 further comprising an agitator coupled to the paddlewheel and driven by the drive mechanism, and extending into the ice storage bin, to agitate ice in the bin when the drive mechanism rotates the paddlewheel.

4. The ice dispenser of claim 1 wherein the connection of the drive shaft to the paddlewheel comprises a coupler, with the drive shaft extending into an axial opening in the coupler.

5. The ice dispenser of claim 4 wherein the paddlewheel is made of molded plastic, and the coupler is molded into the paddlewheel.

6. The ice dispenser of claim 5 wherein the coupler is wider in its center region than at its ends, thus helping to secure the coupler in the paddlewheel.

7. The ice dispenser of claim 4 wherein the coupler comprises a second axial opening, and a shaft for driving an ice bin agitator extends into the second axial opening.

8. The ice dispenser of claim 4 wherein the coupler is made of molded material having a Young's modulus of at least 2,000,000 psi.

9. The ice dispenser of claim 4 wherein the coupler has two axial openings, separated by a wall.

10. An ice dispenser comprising:

a) an ice storage bin with a drive shaft aperture and an ice dispensing aperture;

b) an ice dispensing chute connected to the storage bin in proximity to the ice dispensing aperture;

c) a paddlewheel inside the storage bin; and d) a drive mechanism, including a solid drive shaft passing through the drive shaft aperture, for rotation of the paddlewheel, said paddlewheel not directly in contact with said drive shaft;

e) the drive shaft being slideably connected to the paddlewheel without any fastening device in such a fashion that the paddlewheel is prevented from disengaging from the drive shaft during normal operation of the ice dispensing apparatus, but the drive shaft can be disengaged from the paddlewheel in order to be able to remove the drive mechanism from the ice dispenser without accessing the ice storage bin; and f) an agitator coupled to the drive mechanism, the agitator comprising a shaft that extends through the ice bin and is supported by a rear wall of the ice bin opposite the paddlewheel wherein a bushing is used to support the agitator shaft on the rear wall, and wherein the bushing includes a cavity and a removable stop, the stop being in place during normal operation to prevent the agitator shaft from moving axially in the cavity, thus preventing the paddlewheel from disengaging from the drive shaft during normal operation, but the cavity being deep enough that when the stop is removed, a second end of the agitator shaft can slide deeper into the cavity, allowing a first end of the agitator shaft to be disconnected from the drive mechanism.

11. A combined ice and beverage dispenser comprising:

a) at least one beverage dispensing nozzle;

b) an ice storage bin with a drive shaft aperture and an ice dispensing aperture;

c) an ice dispensing chute connected to the storage bin in proximity to the ice dispensing aperture;

d) at least one paddlewheel located in the ice storage bin, the paddlewheel being made of molded plastic and comprising a coupler molded into the paddlewheel, extending axially through the paddlewheel, the coupler having a first opening; and e) a drive motor and gear assembly having a solid drive shaft extending through the drive shaft aperture and into the coupler, the drive shaft fitting into the first opening of the coupler, the drive shaft and opening having surfaces configured to transmit torque from the drive shaft, through the coupler, to rotate the paddlewheel;

f) the drive shaft being slideably engaged without any fastening device in the coupler during normal operation, so that the drive motor and gear assembly can be detached from the paddlewheel without accessing the ice storage bin; and g) an agitator coupled to the drive mechanism, the agitator comprising a shaft that extends through the ice bin and is supported by a rear wall of the ice bin opposite the paddlewheel, wherein a bushing is used to support the agitator shaft on the rear wall, and wherein the bushing includes a cavity and a removable stop, the stop being in place during normal operation to prevent the agitator shaft from moving axially in the cavity, thus preventing the paddlewheel from disengaging from the drive shaft during normal operation, but the cavity being deep enough that when the stop is removed, a second end of the agitator shaft can slide deeper into the cavity, allowing a first end of the agitator shaft to be disconnected from the drive mechanism.

12. The ice dispenser of claim 1 wherein the ice dispenser is built into an ice and beverage dispenser.

* * * * *